US011341915B2

(12) United States Patent
Yin

(10) Patent No.: US 11,341,915 B2
(45) Date of Patent: May 24, 2022

(54) GAMMA VOLTAGE COMPENSATION CIRCUIT AND GAMMA VOLTAGE COMPENSATION METHOD, SOURCE DRIVER, AND DISPLAY PANEL

(71) Applicant: BOE TECHNOLOGY GROUP CO., LTD., Beijing (CN)

(72) Inventor: Xinshe Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 259 days.

(21) Appl. No.: 16/610,630

(22) PCT Filed: May 7, 2019

(86) PCT No.: PCT/CN2019/085874
§ 371 (c)(1),
(2) Date: Nov. 4, 2019

(87) PCT Pub. No.: WO2020/010910
PCT Pub. Date: Jan. 16, 2020

(65) Prior Publication Data

US 2021/0335256 A1 Oct. 28, 2021

(30) Foreign Application Priority Data

Jul. 9, 2018 (CN) ..... 201810745513.3

(51) Int. Cl.
*G09G 3/3266* (2016.01)
*G09G 3/3258* (2016.01)

(52) U.S. Cl.
CPC ..... *G09G 3/3258* (2013.01); *G09G 3/3266* (2013.01); *G09G 2300/0819* (2013.01);
(Continued)

(58) Field of Classification Search
CPC .. G09G 3/3233; G09G 3/3258; G09G 3/3266; G09G 3/3275; G09G 3/3291;
(Continued)

(56) References Cited

U.S. PATENT DOCUMENTS

2006/0022925 A1* 2/2006 Hara ..... G09G 3/3688 345/89
2007/0120792 A1* 5/2007 Sasaki ..... G09G 3/3696 345/89

(Continued)

FOREIGN PATENT DOCUMENTS

CN 1588191 3/2005
CN 101320545 12/2008

(Continued)

OTHER PUBLICATIONS

Chinese Office Action dated October 9,2 019 corresponding to Chinese Patent Application No. 201810745513.3; 17 pages.

*Primary Examiner* — Michael J Eurice
(74) *Attorney, Agent, or Firm* — Leason Ellis LLP

(57) ABSTRACT

A gamma voltage compensation circuit, a gamma voltage compensation method, a source driver, and a display panel are provided. The gamma voltage compensation circuit includes: a generation circuit, configured to generate a plurality of voltage compensation amounts which are in one-to-one correspondence to a plurality of standard gray scale levels; a calculation circuit, connected to the generation circuit, and configured to acquire the plurality of voltage compensation amounts and a plurality of reference gamma voltages, and to obtain a plurality of standard voltage signals based on the plurality of reference gamma voltages and the plurality of voltage compensation amounts; a gamma circuit, electrically connected to the calculation circuit, and configured to generate a plurality of compensation voltage signals based on the plurality of standard voltage signals, in which
(Continued)

the plurality of compensation voltage signals are in one-to-one correspondence to a plurality of gray scale levels of a display panel.

20 Claims, 10 Drawing Sheets

(52) U.S. Cl.
CPC ..... *G09G 2300/0847* (2013.01); *G09G 2310/066* (2013.01); *G09G 2320/0233* (2013.01); *G09G 2320/0247* (2013.01); *G09G 2320/0673* (2013.01)

(58) Field of Classification Search
CPC ... G09G 2300/0819; G09G 2300/0847; G09G 2310/027; G09G 2310/066; G09G 2320/0233; G09G 2320/0247; G09G 2320/0276; G09G 2320/0673
See application file for complete search history.

(56) References Cited

U.S. PATENT DOCUMENTS

| | | | | |
|---|---|---|---|---|
| 2010/0225511 | A1* | 9/2010 | Nishimura ..... | G09G 3/3688 341/118 |
| 2015/0187263 | A1* | 7/2015 | Yang ..... | G09G 3/2011 345/212 |

FOREIGN PATENT DOCUMENTS

| | | |
|---|---|---|
| CN | 101441845 | 5/2009 |
| CN | 103065594 | 4/2013 |
| CN | 103794187 | 5/2014 |
| CN | 104281189 | 1/2015 |
| CN | 104637435 | 5/2015 |
| CN | 104680998 | 6/2015 |
| CN | 104751759 | 7/2015 |
| CN | 104795036 | 7/2015 |
| CN | 105070248 | 11/2015 |
| CN | 106847217 | 6/2017 |
| CN | 108847184 | 11/2018 |
| KR | 20040037587 | 5/2004 |

* cited by examiner

GAMMA VOLTAGE COMPENSATION CIRCUIT AND GAMMA VOLTAGE COMPENSATION METHOD, SOURCE DRIVER, AND DISPLAY PANEL

CROSS-REFERENCE TO RELATED APPLICATIONS

The present application is a U.S. National Stage Application under 35 U.S.C. § 371 of International Patent Application No. PCT/CN2019/085874, filed May 7, 2019, which claims priority to Chinese Patent Application No. 201810745513.3 filed on Jul. 9, 2018, both of which are incorporated by reference in their entirety herein as part of the disclosure of this application.

TECHNICAL FIELD

Embodiments of the present disclosure relate to a gamma voltage compensation circuit, a gamma voltage compensation method, a source driver, and a display panel.

BACKGROUND

Generally, a scan mode of a display panel may include an interlaced scan mode and a progressive scan mode. The progressive scan mode has the advantages of clear picture without flicker, small dynamic distortion, and more stable picture. Therefore, most display panels currently use the progressive scan mode. The display panel is scanned in the progressive scan mode, and a pixel drive circuit of the display panel scans pixels row by row, so that data signals are stored row by row into data storage capacitors. Due to the leakage of the data storage capacitor, gate voltages of drive transistors of different pixel rows are different, which affects the display quality of the display panel.

SUMMARY

At least some embodiments of the present disclosure provide a gamma voltage compensation circuit, including: a generation circuit, configured to generate a plurality of voltage compensation amounts, in which the plurality of voltage compensation amounts are in one-to-one correspondence to a plurality of standard gray scale levels; a calculation circuit, connected to the generation circuit, and configured to acquire the plurality of voltage compensation amounts and a plurality of reference gamma voltages, and to obtain a plurality of standard voltage signals based on the plurality of reference gamma voltages and the plurality of voltage compensation amounts, in which the plurality of reference gamma voltages are also in one-to-one correspondence to the plurality of standard gray scale levels; and a gamma circuit, electrically connected to the calculation circuit, and configured to generate a plurality of compensation voltage signals based on the plurality of standard voltage signals, in which the plurality of compensation voltage signals are in one-to-one correspondence to a plurality of gray scale levels of a display panel.

For example, in the gamma voltage compensation circuit according to at least some embodiments of the present disclosure, the generation circuit includes a signal generator and an adjustment sub-circuit, the signal generator is configured to generate a standard signal; and the adjustment sub-circuit is electrically connected to an output end of the signal generator and is configured to divide a voltage of the standard signal to obtain the plurality of voltage compensation amounts.

For example, in the gamma voltage compensation circuit according to at least some embodiments of the present disclosure, the standard signal is a sawtooth wave signal, and a period of the sawtooth wave signal is identical to a scan period of the display panel.

For example, in the gamma voltage compensation circuit according to at least some embodiments of the present disclosure, the adjustment sub-circuit includes a plurality of adjustment resistors, the plurality of adjustment resistors are arranged in series between the output end of the signal generator and a first power supply end, and the adjustment sub-circuit is provided with a plurality of voltage dividing output ends between the first power supply end and the plurality of adjustment resistors to respectively output the plurality of voltage compensation amounts.

For example, in the gamma voltage compensation circuit according to at least some embodiments of the present disclosure, a voltage dividing output end close to the first power supply end is a first voltage dividing output end, a voltage dividing output end close to the signal generator is an N-th voltage dividing output end, N represents a count of the plurality of adjustment resistors, and N≥2, an n-th voltage compensation amount of the plurality of voltage compensation amounts output by an n-th voltage dividing output end of the plurality of voltage dividing output ends is expressed as:

$$\Delta VG_n = \frac{\Delta V_{max} \cdot \sum_{i=1}^{n-1} r_i}{\sum_{j=1}^{N} r_j}$$

Where n, i and j are positive integers, n≤N, Δ VGn represents the n-th voltage compensation amount, Δ $V_{max}$ represents the standard signal, $r_i$ represents a resistance value of an i-th adjustment resistor of the plurality of adjustment resistors, and $r_j$ represents a resistance value of a j-th adjustment resistor of the plurality of adjustment resistors.

For example, in the gamma voltage compensation circuit according to at least some embodiments of the present disclosure, the calculation circuit includes a plurality of addition sub-circuits, the plurality of addition sub-circuits are electrically connected to the plurality of voltage dividing output ends in one-to-one correspondence, each of the plurality of addition sub-circuits corresponds to one standard gray scale level of the plurality of standard gray scale levels, and is configured to receive a reference gamma voltage corresponding to the standard gray scale level and a voltage compensation amount corresponding to the standard gray scale level, and to add the reference gamma voltage and the voltage compensation amount to obtain a standard voltage signal corresponding to the standard gray scale level.

For example, in the gamma voltage compensation circuit according to at least some embodiments of the present disclosure, each of the plurality of addition sub-circuits includes an operational amplifier, a first resistor, a second resistor, a third resistor, and a fourth resistor, a first end of the first resistor is electrically connected to a non-inverting input end of the operational amplifier, and a second end of the first resistor is configured to be electrically connected to a corresponding voltage dividing output end to receive the corresponding voltage compensation amount; a first end of the second resistor is electrically connected to the non-inverting input end of the operational amplifier, and a second end of the second resistor is configured to receive the corresponding reference gamma voltage; a first end of the third resistor is electrically connected to an inverting input end of the operational amplifier, and a second end of the third resistor is electrically connected to a second power supply end; a first end of the fourth resistor is electrically connected to the inverting input end of the operational amplifier, and a second end of the fourth resistor is electrically connected to an output end of the operational amplifier; and the output end of the operational amplifier outputs the standard voltage signal corresponding to the standard gray scale level to the gamma circuit.

For example, in the gamma voltage compensation circuit according to at least some embodiments of the present disclosure, a resistance value of the first resistor is identical to a resistance value of the second resistor, and a resistance value of the third resistor is identical to a resistance value of the fourth resistor.

For example, in the gamma voltage compensation circuit according to at least some embodiments of the present disclosure, the generation circuit further includes a voltage follower, an input end of the voltage follower is electrically connected to the output end of the signal generator, and an output end of the voltage follower is electrically connected to the adjustment sub-circuit.

For example, the gamma voltage compensation circuit according to at least some embodiments of the present disclosure further includes an output circuit, the output circuit is electrically connected to the gamma circuit, in a case where a P-th row of pixels is scanned, for a T-th pixel located in the P-th row of pixels, the T-th pixel is set to display brightness corresponding to an S-th gray scale level, and the output circuit is configured to acquire a compensation voltage signal corresponding to the S-th gray scale level from the gamma circuit, determine a compensation voltage value corresponding to the P-th row of pixels in the compensation voltage signal; and output the compensation voltage value as a data voltage of the T-th pixel, where P, T, and S are all positive integers, P is greater than or equal to One and is less than or equal to a total count of rows of the display panel, T is greater than or equal to One and is less than or equal to a total count of columns of the display panel, and S is greater than or equal to 0 and is less than or equal to a total count of gray scale levels of the display panel.

For example, in the gamma voltage compensation circuit according to at least some embodiments of the present disclosure, the data voltage corresponding to the T-th pixel located in the P-th row of pixels is expressed as:

$$V_{CP} = V_P - \frac{Q-P}{Q-1} \cdot \Delta V_{Pmax}$$

Where $V_{CP}$ represents the data voltage corresponding to the T-th pixel of the P-th row of pixels, Q represents the total count of rows of pixels of the display panel, Q is a positive integer, $V_P$ represents an initial gamma voltage corresponding to the S-th gray scale level, $\Delta V_{Pmax}$ represents a difference between a gate voltage of a drive transistor of a T-th pixel of a first row of pixels of the display panel and a gate voltage of a drive transistor of a T-th pixel of a last row of pixels of the display panel at the initial gamma voltage $V_P$, and ΔV Pmax is expressed as: $\Delta V_{Pmax}=\alpha\cdot(V_{ref}-V_P)+\beta$, where α and β represent compensation coefficients and are constant, and $V_{ref}$ represents a reference voltage.

For example, in the gamma voltage compensation circuit according to at least some embodiments of the present disclosure, the gamma circuit includes a plurality of gamma resistors connected in series, the gamma circuit is configured to divide voltages of the plurality of standard voltage signals by the plurality of gamma resistors respectively to generate the plurality of compensation voltage signals which are in one-to-one correspondence to the plurality of gray scale levels of the display panel.

At least some embodiments of the present disclosure further provide a gamma voltage compensation method of the gamma voltage compensation circuit according to any one of the above embodiments, including: generating the plurality of voltage compensation amounts which are in one-to-one correspondence to the plurality of standard gray scale levels; calculating to obtain the plurality of standard voltage signals based on the plurality of voltage compensation amounts and the plurality of reference gamma voltages, in which the plurality of standard voltage signals are in one-to-one correspondence to the plurality of standard gray scale levels; and generating the plurality of compensation voltage signals based on the plurality of standard voltage signals, in which the plurality of compensation voltage signals are in one-to-one correspondence to the plurality of gray scale levels of the display panel.

For example, in the gamma voltage compensation method according to at least some embodiments of the present disclosure, generating the plurality of voltage compensation amounts which are in one-to-one correspondence to the plurality of standard gray scale levels includes: generating a standard signal; determining the plurality of standard gray scale levels; and dividing a voltage of the standard signal to obtain the plurality of voltage compensation amounts based on the plurality of standard gray scale levels.

For example, in the gamma voltage compensation method according to at least some embodiments of the present disclosure, the standard signal is a sawtooth wave signal, and a period of the sawtooth wave signal is the same as a scan period of the display panel.

For example, in the gamma voltage compensation method according to at least some embodiments of the present disclosure, each of the plurality of compensation voltage signals is a sawtooth wave signal.

For example, in the gamma voltage compensation method according to at least some embodiments of the present disclosure, in a case where a P-th row of pixels is scanned, for a T-th pixel located in the P-th row of pixels, the T-th pixel is set to display brightness corresponding to an S-th gray scale level, the gamma voltage compensation method further includes: acquiring a compensation voltage signal corresponding to the S-th gray scale level from the plurality of compensation voltage signals, determining a compensation voltage value corresponding to the P-th row of pixels in the compensation voltage signal; outputting the compensation voltage value as a data voltage of the T-th pixel, where P, T, and S are all positive integers, P is greater than or equal to One and is less than or equal to a total count of rows of the display panel, T is greater than or equal to One and is less than or equal to a total count of columns of the display panel, and S is greater than or equal to 0 and is less than or equal to a total count of gray scale levels of the display panel.

At least some embodiments of the present disclosure also provide a source driver including the gamma voltage compensation circuit according to any one of the above embodiments.

At least some embodiments of the present disclosure also provide a display panel including the source driver according to any one of the above embodiments.

BRIEF DESCRIPTION OF THE DRAWINGS

In order to more clearly illustrate the technical solutions of the embodiments of the present disclosure, the drawings of the embodiments will be briefly described below. It is obvious that the drawings in the following description relate only to some embodiments of the present disclosure, and are not intended to limit the present disclosure.

DETAILED DESCRIPTION

Figure 1:
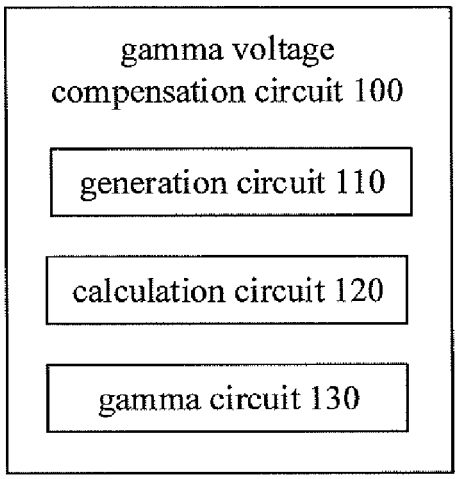
FIG. 1 is a schematic block diagram of a gamma voltage compensation circuit according to some embodiments of the present disclosure.

In order to make objects, technical details and advantages of the embodiments of the disclosure apparent, the technical solutions of the embodiments of the present disclosure will be described below in a clearly and fully understandable way in conjunction with the drawings of the embodiments of the present disclosure. It is apparent that the described embodiments are just a part of the embodiments of the present disclosure, and not all of the embodiments of the present disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "include," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly. In order to keep the following description of the embodiments of the present disclosure clear and concise, the present disclosure omits detailed descriptions of known functions and known components.

In a display panel (e.g., an organic light-emitting diode display panel (OLED)), in a scan phase, a pixel drive circuit scans pixels row by row to write initial data voltages into data storage capacitors of the pixels row by row, and therefore, data storage capacitors of pixels in a first row on the display panel store and hold the initial data voltages for the longest time, and data storage capacitors of pixels in a last row on the display panel store and hold the initial data voltages for the shortest time. When the scan phase is over, in a display phase, a plurality of rows of pixels in the display panel simultaneously display. Due to the leakage phenomenon of the data storage capacitors, there is a difference between the data voltage stored in the data storage capacitor and the initial data voltage written during the scan phase for each row of pixels, thereby affecting a display effect of the display panel.

At least some embodiments of the present disclosure provide a gamma voltage compensation circuit, a gamma voltage compensation method, a source driver, and a display panel, the gamma voltage compensation circuit can compensate a gamma voltage, thereby compensating a data voltage output by a drive chip, improving brightness uniformity of the display panel, and improving the display effect of the display panel. In addition, compared with a compensation method of adding a compensation circuit to each output channel of the drive chip, only one gamma voltage compensation circuit needs to be added in the present disclosure to compensate all the data voltages output by the drive chip, so that a structure of the drive chip is simple, and the occupied area of the drive chip is reduced.

Several embodiments of the present disclosure are described in detail below with reference to the accompanying drawings, but the present disclosure is not limited to these specific embodiments.

FIG. 1 is a schematic block diagram of a gamma voltage compensation circuit according to some embodiments of the present disclosure.

For example, as shown in FIG. 1, a gamma voltage compensation circuit 100 according to some embodiments of the present disclosure includes a generation circuit 110, a calculation circuit 120, and a gamma circuit 130. The generation circuit 110 is configured to generate a plurality of voltage compensation amounts, the plurality of voltage compensation amounts are in one-to-one correspondence to a plurality of standard gray scale levels. The calculation circuit 120 is connected (e.g., communicatively connected) to the generation circuit 110, and is configured to acquire the plurality of voltage compensation amounts and a plurality of reference gamma voltages, and to obtain a plurality of standard voltage signals based on the plurality of reference gamma voltages and the plurality of voltage compensation amounts, the plurality of reference gamma voltages are also in one-to-one correspondence to the plurality of standard gray scale levels. The gamma circuit 130 is electrically connected to the calculation circuit 120, and is configured to generate a plurality of compensation voltage signals based on the plurality of standard voltage signals, the plurality of compensation voltage signals are in one-to-one correspondence to a plurality of gray scale levels of a display panel.

The gamma voltage compensation circuit provided by the embodiment of the present disclosure can compensate the gamma voltage, thereby compensating brightness difference caused by a time difference of the data storage capacitors maintaining the data voltages, improving brightness uniformity of the display panel, and improving the display effect of the display panel.

For example, the plurality of gray scale levels of the display panel may include 256 gray scale levels (0-255 gray scale), i.e. each pixel is represented by 8-bit data. The plurality of standard gray scale levels may be selected from the plurality of gray scale levels (e.g., 256 gray scale levels) of the display panel. The number of the plurality of standard gray scale levels may be 5, and the plurality of standard gray scale levels are 0 gray scale, 64 gray scale, 128 gray scale, 192 gray scale, and 255 gray scale, respectively. The present disclosure does not limit the number and specific numerical value of the plurality of standard gray scale levels.

For example, a plurality of initial gamma voltages corresponding to the plurality of gray scale levels can be obtained according to the gamma curve and the transmittance-voltage curve. The count of the plurality of initial gamma voltages is the same as the count of the plurality of gray scale levels of the display panel, and the plurality of initial gamma voltages are in one-to-one correspondence with the plurality of gray scale levels. The calculation circuit 120 may select gamma voltages corresponding to the plurality of standard gray scale levels from the plurality of initial gamma voltages as the plurality of reference gamma voltages.

Next, the principle of the variation amount of the gate voltage of the drive transistor due to the leakage phenomenon of the storage capacitor will be described.

Figure 2A:
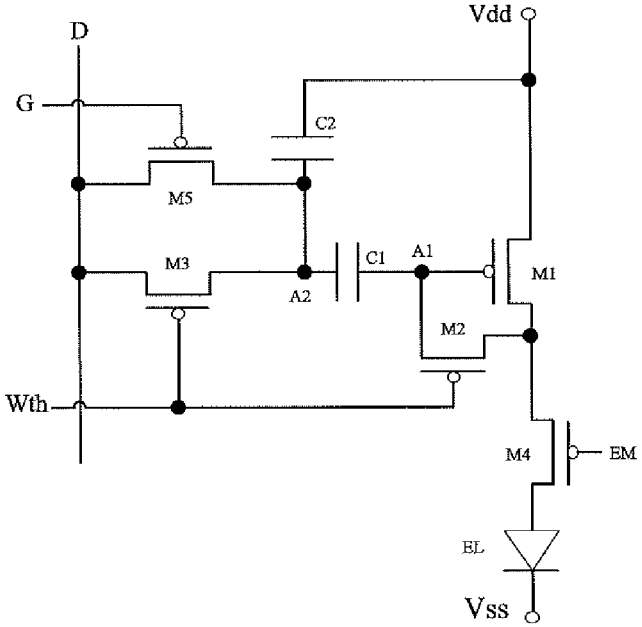
FIG. 2A is a schematic structural diagram of a pixel drive circuit according to some embodiments of the present disclosure.
Figure 2B:
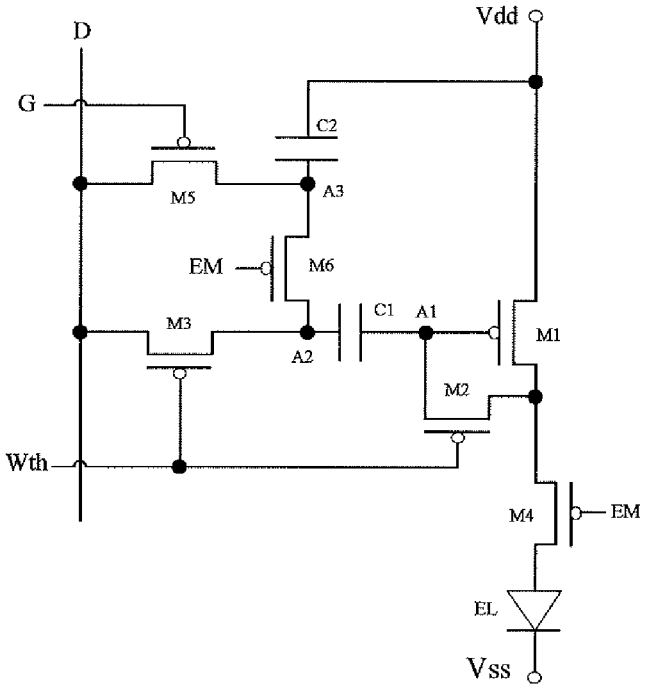
FIG. 2B is a schematic structural diagram of another pixel drive circuit according to some embodiments of the present disclosure.
Figure 3:
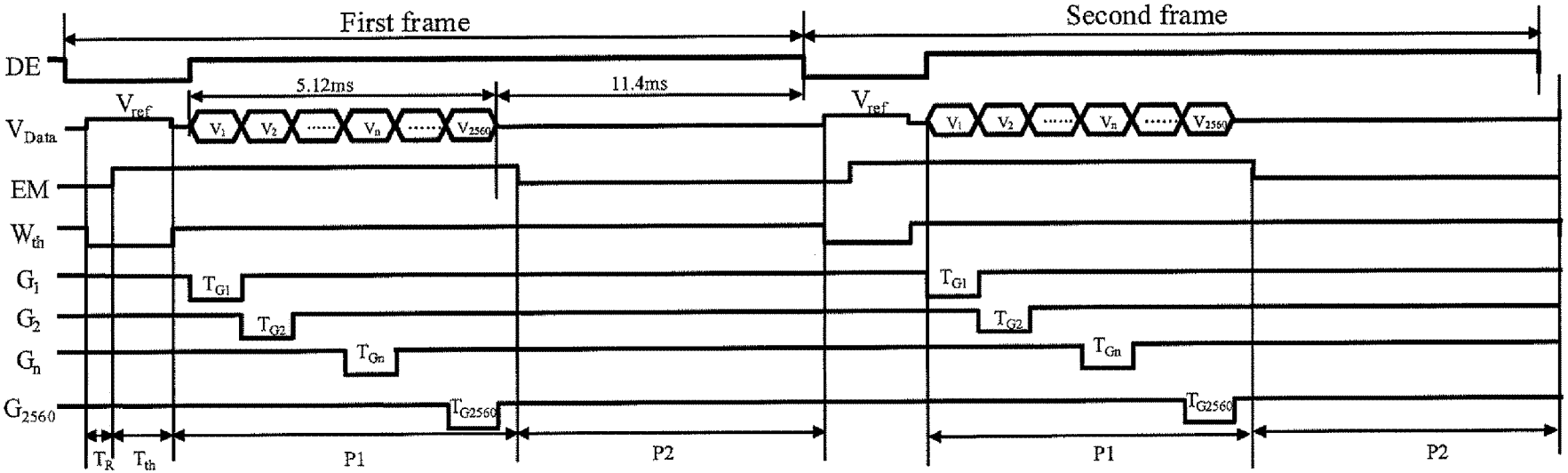
FIG. 3 is a timing diagram of the pixel drive circuits shown in FIGS. 2A and 2B.

FIG. 2A is a schematic structural diagram of a pixel drive circuit according to some embodiments of the present disclosure, FIG. 2B is a schematic structural diagram of another pixel drive circuit according to some embodiments of the present disclosure, and FIG. 3 is a timing diagram of the pixel drive circuits shown in FIGS. 2A and 2B.

For example, in some embodiments, as shown in FIG. 2A, a pixel drive circuit can be implemented as a 5T2C circuit, that is, using five thin film transistors (TFTs) and two storage capacitors to achieve the basic function of driving a light-emitting device to emit light. For example, as shown in FIG. 2A, the pixel drive circuit may include a drive transistor M1, a first switch transistor M2, a second switch transistor M3, a third switch transistor M4, a fourth switch transistor M5, a threshold storage capacitor C1, and a data storage capacitor C2.

For example, in other embodiments, as shown in FIG. 2B, a pixel drive circuit can be implemented as a 6T2C circuit, that is, using six thin film transistors (TFTs) and two storage capacitors to achieve the basic function of driving a pixel to emit light. For example, as shown in FIG. 2B, the pixel drive circuit may include a drive transistor M1, a first switch transistor M2, a second switch transistor M3, a third switch transistor M4, a light-emitting control transistor M6, a fourth switch transistor M5, a threshold storage capacitor C1, and a data storage capacitor C2.

For example, as shown in FIGS. 2A and 2B, the threshold storage capacitor C1 is configured to store a threshold voltage of the drive transistor M1, and the data storage capacitor C2 is configured to store a data voltage.

For example, as shown in FIG. 2A, FIG. 2B, and FIG. 3, Vdd represents a third power supply end, Vss represents a fourth power supply end; DE represents a data enable signal, $V_{ref}$ represents a reference voltage, $V_{Data}$ represents a data voltage, D represents a data line, G represents a scan line, EM represents a light-emitting control signal, and Wth represents a compensation control signal. The data line D can transmit the reference voltage $V_{ref}$ and the data voltage $V_{Data}$ in time-sharing manner, the reference voltage $V_{ref}$ is transmitted to the threshold storage capacitor C1, and the data voltage $V_{Data}$ is transmitted to the data storage capacitor C2.

For example, in the present disclosure, each of the transistors shown in FIGS. 2A and 2B may be a field effect transistor. According to the characteristics of the field effect transistor, the field effect transistors can be divided into N-type transistors and P-type transistors. For the purpose of clarity, the embodiments of the present disclosure illustrate the technical solution of the present disclosure in detail by taking the field effect transistor as the P-type transistor (for example, a P-type MOS transistor (PMOS)) as an example. However, the field effect transistor of the embodiments of the present disclosure is not limited to the P-type transistor, and those skilled in the art can also implement the functions of one or more field effect transistors in the embodiments of the present disclosure using the N-type transistor (e.g., an N-type MOS transistor (NMOS)) according to actual needs.

It should be noted that the field effect transistors used in the embodiments of the present disclosure may be field effect transistors such as thin film transistors or other switch device having the same characteristics, and the thin film transistors may include oxide semiconductor thin film transistors, amorphous silicon thin film transistors, or polysilicon thin film transistors, etc. A source electrode and a drain electrode of a field effect transistor may be symmetrical in structures, so that the source electrode and the drain electrode of the field effect transistor may be indistinguishable in physical structures. In the embodiments of the present disclosure, in order to distinguish two electrodes of the field effect transistor except for a gate electrode the field effect transistor as a control electrode, one of the two electrodes is directly described as a first electrode, and the other of the two electrodes is described as a second electrode, so the first electrode and the second electrode of all or part of the field effect transistors in the embodiments of the present disclosure are interchangeable as needed.

For example, as shown in FIG. 2A, FIG. 2B, and FIG. 3, in a case where the light-emitting control signal EM is a low level signal, the pixel drive circuit is in a light-emitting phase P2, and in a case where the light-emitting control signal EM is a high level signal, the pixel drive circuit is in a non-light emitting phase. The non-light emitting phase may include a reset phase $T_R$, a threshold voltage writing phase $T_{th}$, and a scan phase P1. The reset phase $T_R$ and the threshold voltage writing phase $T_{th}$ may be in a field blanking phase, the field blanking phase includes several rows to several tens of rows of scan time, and in the reset phase $T_R$, the gate electrode of the drive transistor M1 (i.e., a node A1) is reset; in the threshold voltage writing phase $T_{th}$, the threshold voltage of the drive transistor M1 can be written to the threshold storage capacitor C1. In the scan phase P1, the data voltages $V_{Data}$ are written row by row from the first row to the last row to the corresponding data storage capacitors C2. In the light-emitting phase P2, the respective light-emitting devices EL of the display panel simultaneously start to emit light.

For example, because the pixel drive circuit performs a progressive scan operation to write the data voltages into the corresponding pixel drive circuits, that is, as shown in FIG. 3, a data voltage $V_1$ corresponding to the first row of pixels is first written, and then a data voltage $V_2$ corresponding to the second row of pixels is written, then a data voltage $V_3$ corresponding to the third row of pixels is written, and so on, until a data voltage $V_{2560}$ corresponding to the last row of pixels (e.g., in this embodiment, the display panel includes 2560 rows of pixels) is written. In the light-emitting phase P2, all the light-emitting devices EL emit light simultaneously, at this time, the data storage capacitors C2 of the first row of pixels store and hold the data voltage (i.e., $V_1$) for the longest time, and the data storage capacitors C2 of the last row of pixels store and hold the data voltage (i.e., $V_{2560}$) for the shortest time. Due to the leakage phenomenon of the threshold storage capacitor C1 and the data storage capacitor C2 in the pixel drive circuit, so that the data storage capacitors C2 of the first row of pixels has the most serious leakage current, that is, the changing amplitude of the data voltage $V_1$ is the largest; and the data storage capacitors C2 of the last row of pixels has the smallest leakage current, that is, the changing amplitude of the data voltage $V_{2560}$ is the smallest.

Figure 4:
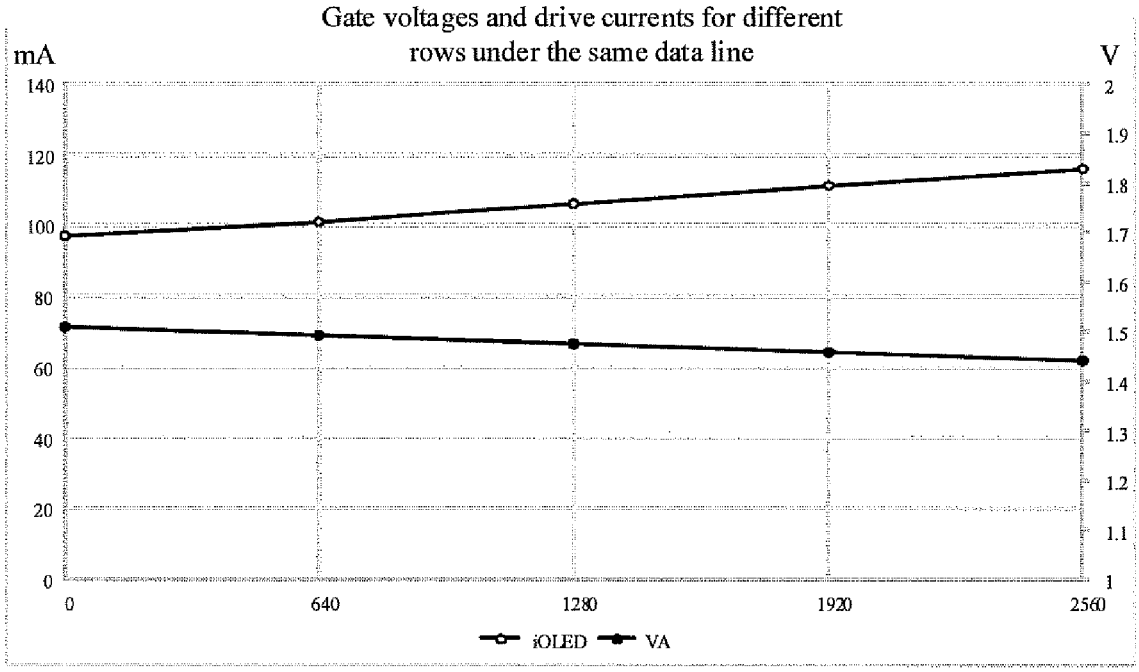
FIG. 4 is a schematic graph of a gate voltage of a drive transistor in a pixel on a display panel and a light-emitting current flowing through the drive transistor according to some embodiments of the present disclosure.

FIG. 4 is a schematic graph of a gate voltage of a drive transistor in a pixel on a display panel and a light-emitting current flowing through the drive transistor according to some embodiments of the present disclosure. For example, in one example, the correspondence relationship between the gate voltage, the light-emitting current, and the number of rows of pixels is as shown in Table 1 below.

TABLE 1

| row of pixels | VA | iOLED |
|---|---|---|
| 0 | 1.5098 | 97 |
| 640 | 1.4928 | 101 |
| 1280 | 1.4756 | 106 |
| 1920 | 1.4585 | 111 |
| 2560 | 1.4407 | 116 |

FIG. 4 is a graph, which is obtained by simulation according to the data in the above table, representing gate voltages of drive transistors and light-emitting currents flowing through the drive transistors of different rows of pixels on the display panel. For example, as shown in FIG. 4, VA represents a gate voltage of a drive transistor in one pixel, and iOLED represents a light-emitting current flowing through the drive transistor in the pixel. As can be seen from Table 1 and FIG. 4, in a case where the scan phase P1 ends (that is, in the light-emitting phase P2), for a certain column of pixels, a gate voltage VA of a drive transistor of the first row of pixels is 1.5098 V, and a light-emitting current of the drive transistor of the first row of pixels is 96 mA; a gate voltage VA of a drive transistor of the last row of pixels (i.e., the 2560-th row of pixels) is 1.4407 V, and a light-emitting current of the drive transistor of the last row of pixels is 116 mA. Due to the leakage phenomenon of the capacitor, in the light-emitting phase P2, the gate voltage of the drive transistor of the last row of pixels is decreased by 5% compared with the gate voltage of the drive transistor of the first row of pixels, the light-emitting current of the last row of pixels is increased by 20% compared with the light-emitting current of the first row of pixels, so that brightness of the last row of pixels is higher than brightness of the first row of pixels, and brightness of the display panel is not uniform.

For example, as shown in FIGS. 2A and 2B, in the light-emitting phase P2, the gate voltage of the drive transistor M1 is $V_{Data}+V_{th}+V_d-V_{ref}$, a source voltage of the drive transistor M1 is $V_d$. Based on the saturation current formula of the drive transistor M1, the light-emitting current $I_{OLED}$ flowing through the drive transistor M1 can be expressed as:

$$I_{OLED} = K(V_{GS} - V_{th})^2 = K[(V_{Data} + V_{th} + V_d - V_{ref}) - V_d - V_{th}]^2 = K(V_{Data} - V_{ref})^2.$$

In the above formula, $V_{GS}$ is a voltage difference between the gate electrode and the source electrode of the drive transistor M1, $V_d$ is a first power supply signal output by the third power supply end Vdd, and $V_{th}$ is the threshold voltage of the drive transistor M1. It can be seen from the above formula that the light-emitting current $I_{OLED}$ has not been affected by the threshold voltage $V_{th}$ of the drive transistor M1 and the first power supply signal $V_d$ of the third power supply end Vdd, but is only related to the reference voltage $V_{ref}$ and the data voltage $V_{Data}$, so that the pixel drive circuit can solve the problem of the threshold voltage drift of the drive transistor M1 due to the technological process and long-time operation and the problem of the IR drop of the display panel. However, because the data voltages $V_{Data}$ corresponding to respective rows of pixels of the display panel are different, at a result, the light-emitting currents $I_{OLED}$ of the respective rows of pixels are different.

For example, in the above formula, K is a constant, and K can be expressed as:

$$K=0.5\mu_n C_{ox}(W/L).$$

where $\mu_n$ is the electron mobility of the drive transistor M1, $c_{ox}$ is the gate unit capacitance of the drive transistor M1, W is the channel width of the drive transistor M1, and L is the channel length of the drive transistor M1.

Figure 5:
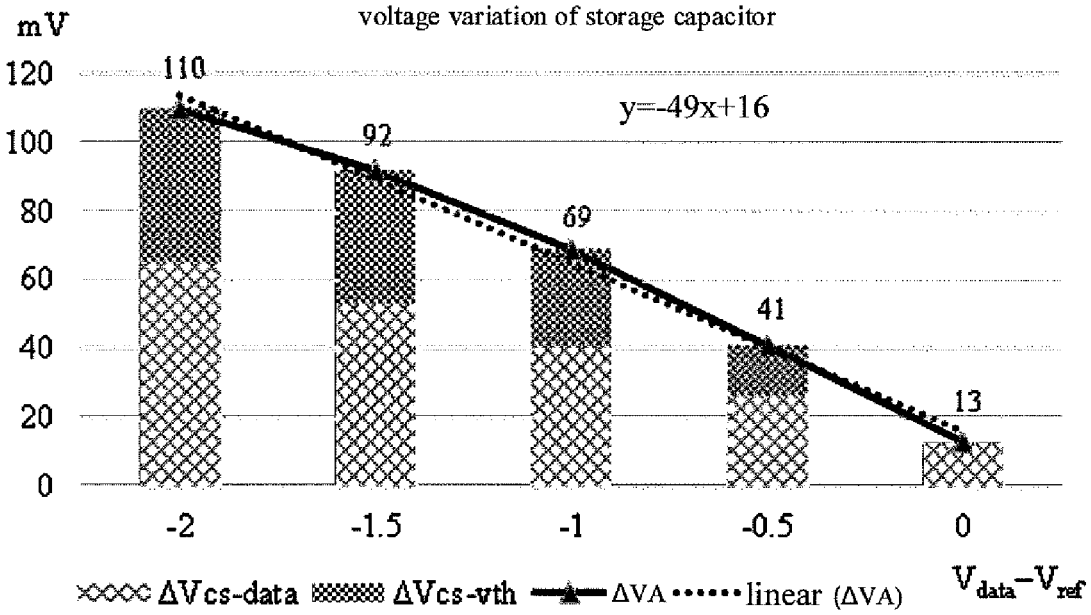
FIG. 5 is a schematic diagram of a voltage variation amount of a gate voltage of a drive transistor according to some embodiments of the present disclosure.

FIG. 5 is a schematic diagram of a voltage variation amount of a gate voltage of a drive transistor according to some embodiments of the present disclosure. For example, in one example, the reference voltage $V_{ref}$ is 3V, the range of the data voltage $V_{Data}$ is 1V~3V, the first power supply signal $V_d$ of the third power supply end Vdd is 4.6 V, a second power supply signal $V_s$ of the fourth power supply end is −2.4V, a capacitance value of the threshold storage capacitor C1 is 0.15 pF, a capacitance value of the data storage capacitor C2 is 0.15 pF, and the threshold voltage of the drive transistor M1 is −2.5V. For example, in the light-emitting phase P2, for a certain column of pixels, ΔVcs-vth represents a difference between the voltage on the threshold storage capacitor C1 of the first row of pixels and the voltage on the threshold storage capacitor C1 of the last row of pixels; ΔVcs-data represents a difference between the voltage on the data storage capacitor C2 of the first row of pixels and the voltage on the data storage capacitor C2 of the last row of pixels; ΔVA represents a difference between the gate voltage of the drive transistor of the first row of pixels and the gate voltage of the drive transistor of the last row of pixels. According to the above simulation parameters, the correspondence relationship among ΔVcs-vth, ΔVcs-data, $V_{data}-V_{ref}$, and ΔVA is as shown in Table 2 below.

TABLE 2

| $V_{Data}-V_{ref}$ | ΔVcs-data | ΔVcs-vth | ΔVA |
|---|---|---|---|
| −2 | 65.7 | 44.3 | 110 |
| −1.5 | 53.8 | 38.1 | 92 |
| −1 | 41 | 28.05 | 69 |
| −0.5 | 26.8 | 14.1 | 41 |
| 0 | 12.4 | 0 | 13 |

FIG. 5 is a schematic diagram, which is obtained by simulation according to the above data, representing the voltage variation amount. The dotted line in FIG. 5 represents a linear fit curve of ΔVA and $V_{Data}-V_{ref}$. The relation of the linear fit curve is:

$$y=-49x+16$$

Where y represents ΔVA and x represents $V_{Data}-V_{ref}$. It can be seen that there is a linear relationship between ΔVA and $V_{Data}-V_{ref}$, that is, ΔVA is related to the data voltage $V_{Data}$. The larger the difference between the data voltage $V_{Data}$ and the reference voltage $V_{ref}$ is, the larger the ΔVA is; and the smaller the difference between the data voltage $V_{Data}$ and the reference voltage $V_{ref}$ is, the smaller the ΔVA is.

For example, the relationship between ΔVA and $V_{Data}-V_{ref}$ can be expressed as the following formula:

$$\Delta VA=\alpha*(V_{Data}-V_{ref})+\beta \quad (1)$$

Where α and β are linear compensation coefficients, and α and β both are constant. α and β can be determined according to the process parameters and drive timing of the display panel. In practical applications, brightness uniformity of the display panel can meets specifications by adjusting α and β. For example, in the example shown in FIG. 5 and Table 2 above, α is −49 and β is 16.

In summary, due to the leakage phenomenon of the storage capacitor, the voltage written to the threshold storage capacitor C1 and the voltage written to the data storage capacitor C2 vary linearly with time, that is, each of the variation amount of the voltage of the threshold storage capacitor C1, the variation amount of the voltage of the data storage capacitor C2, and the variation amount of the gate voltage VA of the drive transistor has a linear relationship with the number of rows of pixels. For example, the variation amount of the gate voltage VA of the drive transistor gradually decreases as the number of rows of pixels increases. For example, a voltage adjustment value $\Delta V_{PT}$ of the T-th pixel located in the P-th row of pixels can be expressed as the following formula:

$$\Delta V_{PT}=\frac{Q-P}{Q-1}\cdot\Delta VA=\frac{Q-P}{Q-1}\cdot[\alpha\cdot(V_{Data}-V_{ref})+\beta].$$

Where Q represents the total number of rows of pixels of the display panel, and Q is a positive integer, P is a positive integer, and P is smaller than Q, and $V_{Data}$ represents an initial data voltage corresponding to the T-th pixel of the P-th row of pixels (i.e., uncompensated data voltage), ΔVA represents the difference between the gate voltage of the drive transistor of the T-th pixel of the first row of pixels of the display panel and the gate voltage of the drive transistor of the T-th pixel of the last row of pixels of the display panel. Based on the above description, the voltage adjustment value of each pixel is related not only to the data voltage but also to the position of the pixel (that is, pixel row number).

The gamma voltage compensation circuit according to the embodiments of the present disclosure compensates the data voltage output by the source driver by compensating the gamma voltage using the one-to-one correspondence relationship between the output data voltage and the gamma voltage, thereby improving brightness uniformity of the display panel. In addition, compared with the compensation method of adding the compensation circuit to each output channel of the source driver, only one gamma voltage compensation circuit needs to be added in the present disclosure to compensate all the data voltages output by the source driver, so that a structure of the source driver is simple, and the occupied area of the source driver is reduced.

Hereinafter, a specific structure of a gamma voltage compensation circuit according to the embodiments of the present disclosure will be described with reference to FIGS. 6-9.

Figure 6:
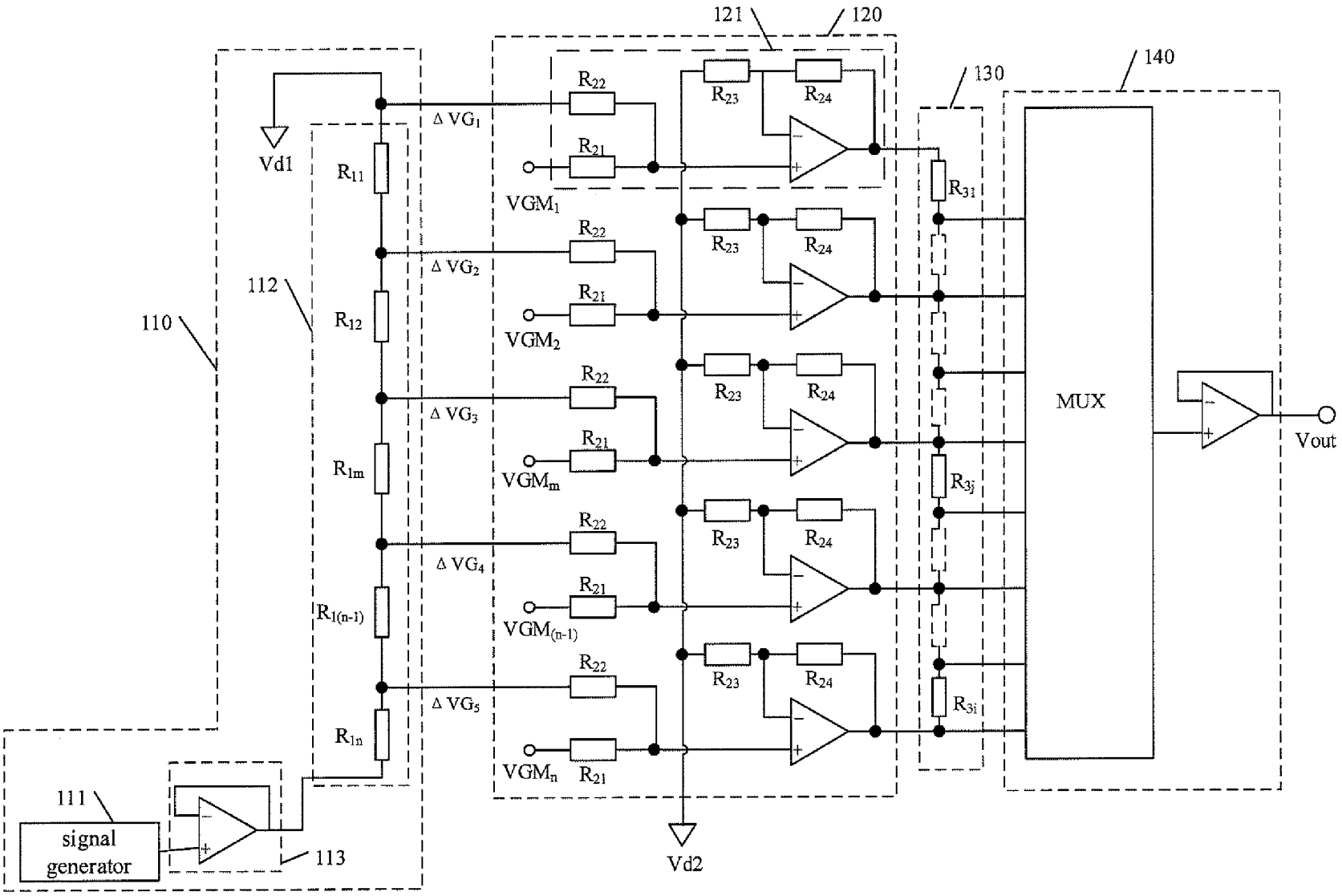
FIG. 6 is a structural diagram of a gamma voltage compensation circuit according to some embodiments of the present disclosure.
Figure 7A:
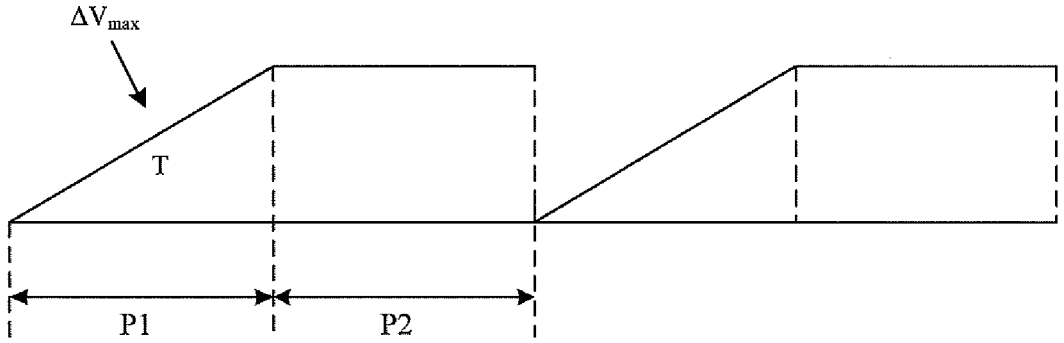
FIG. 7A is a schematic diagram of a standard signal according to some embodiments of the present disclosure.
Figure 7B:
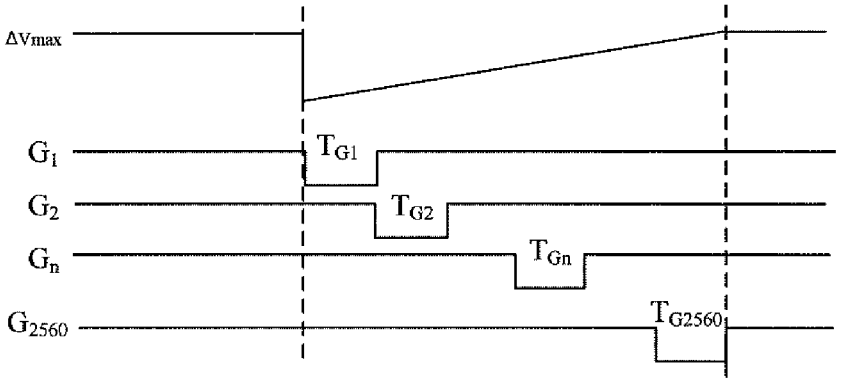
FIG. 7B is a schematic diagram of a correspondence between a standard signal and a scan phase according to some embodiments of the present disclosure.
Figure 7C:
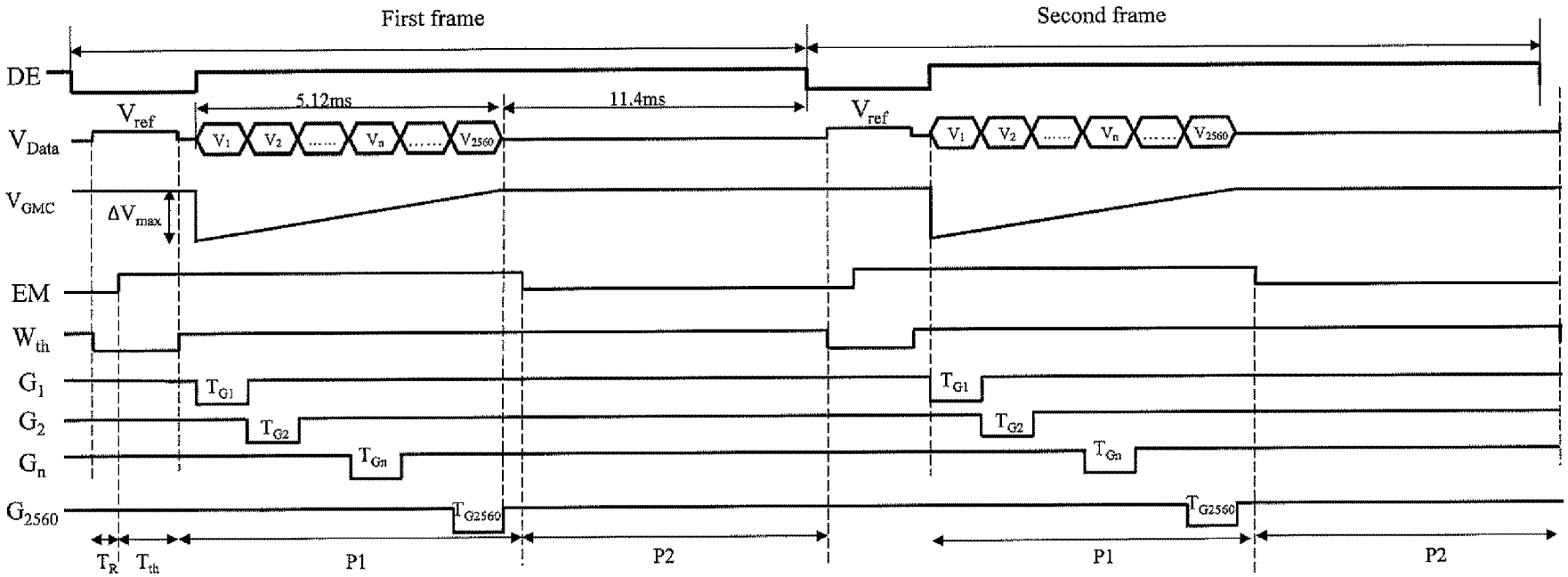
FIG. 7C is a timing diagram applied to pixel drive circuits shown in FIGS. 2A and 2B according to some embodiments of the present disclosure.
Figure 8:
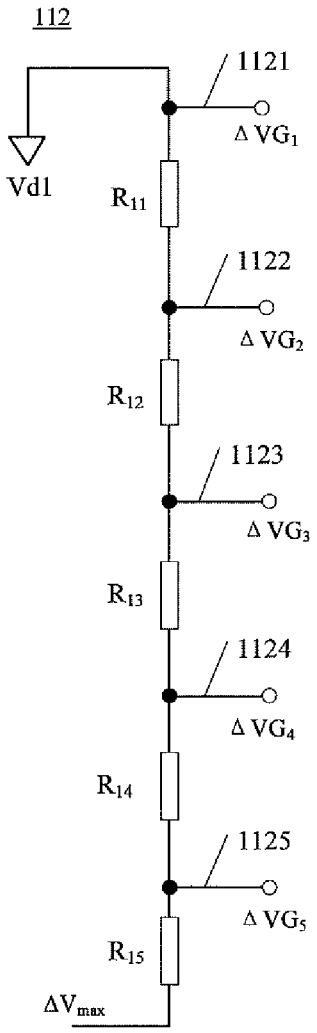
FIG. 8 is a schematic structural diagram of an adjustment sub-circuit according to some embodiments of the present disclosure.

FIG. 6 is a structural diagram of a gamma voltage compensation circuit according to some embodiments of the present disclosure; FIG. 7A is a schematic diagram of a standard signal according to some embodiments of the present disclosure; FIG. 7B is a schematic diagram of a correspondence between a standard signal and a scan phase according to some embodiments of the present disclosure; FIG. 7C is a timing diagram applied to pixel drive circuits shown in FIGS. 2A and 2B according to some embodiments of the present disclosure; FIG. 8 is a schematic structural diagram of an adjustment sub-circuit according to some embodiments of the present disclosure.

For example, as shown in FIG. 6, the generation circuit 110 includes a signal generator 111 and an adjustment sub-circuit 112. The signal generator 111 is configured to generate a standard signal; the adjustment sub-circuit 112 is electrically connected to an output end of the signal generator 111 and is configured to divide a voltage of the standard signal to obtain the plurality of voltage compensation amounts.

For example, as shown in FIG. 7A, the standard signal may be a sawtooth wave signal, and the plurality of voltage compensation amounts may also be sawtooth wave signals. In FIG. 7A, the P1 phase is the scan phase of the display panel, and the P2 phase is the light-emitting phase of the display panel. A period T of the sawtooth wave signal is the same as a scan period of the display panel, that is, the period T of the sawtooth wave signal is the same as the time of the scan phase P1. It should be noted that, in the present disclosure, the period T of the sawtooth wave signal represents the duration of the sawtooth wave, that is, the time corresponding to the scan phase P1 in FIG. 7A.

For example, the standard signal may correspond to the maximum gray scale level of the display panel, that is, the standard signal is a voltage compensation amount at the maximum gray scale level. For example, in the present disclosure, a difference between the gate voltage of the drive transistor of the first row of pixels in a column of pixels and the gate voltage of the drive transistor of the last row of pixels in the column of pixels may be expressed as a gate voltage difference, i.e., the gate voltage difference is a value obtained by subtracting the gate voltage of the drive transistor of the last row of pixels from the gate voltage of the drive transistor of the first row of pixels. In a case where the standard signal is a negative signal, the maximum value of the standard signal may be 0, and the minimum value of the standard signal may be the gate voltage difference of a certain column of pixels of the display panel at the maximum gray scale level; or, the minimum value of the standard signal may also be the average of the gate voltage differences of all columns of pixels of the display panel at the maximum gray scale level. In a case where the standard signal is a positive signal, the minimum value of the standard signal may be 0, and the maximum value of the standard signal may be the gate voltage difference of a certain column of pixels of the display panel at the maximum gray scale level; or, the maximum value of the standard signal may also be the average of the gate voltage differences of all columns of pixels of the display panel at the maximum gray scale level.

For example, because the voltage adjustment value of each pixel is related to the row number of the pixel, the voltage compensation amount can be divided into voltage adjustment values corresponding to the respective rows of pixels by timing to achieve compensation for each pixel. As shown in FIGS. 7B and 7C, in a case where a certain column of pixels are configured to display brightness corresponding to the maximum gray scale level, the voltage compensation amount corresponding to the certain column of pixels is the standard signal, in a case where the first row of pixels is scanned, the voltage adjustment value of the first row of pixels may be a value of the standard signal at the falling edge of the scan signal $G_1$; in a case where the second row of pixels is scanned, the voltage adjustment value of the second row of pixels may be a value of the standard signal at the falling edge of the scan signal $G_2$, and so on, so that a voltage adjustment value corresponding to each pixel in the certain column of pixels can be obtained. It should be noted that in a case where the first row of pixels is scanned, the voltage adjustment value of the first row of pixels may also be the average value of the standard signal within the scan time $T_{G1}$.

It should be noted that the standard signal may also include a plurality of square waves. During the scan period of the display panel, the plurality of square waves have different amplitudes, the number of the plurality of square waves is the same as the total number of rows of the pixels on the display panel, each square wave corresponds to one row of pixels, and a width of each square wave is the same as the scan time of one row of pixels.

For example, as shown in FIG. 6, the adjustment sub-circuit 112 may include a plurality of adjustment resistors, and the plurality of adjustment resistors are arranged in series between the output end of the signal generator 111 and a first power supply end Vd1. As shown in FIG. 8, in one example, the adjustment sub-circuit 112 may include five adjustment resistors, that is, n in FIG. 6 is 5. The adjustment sub-circuit 112 may include a first adjustment resistor R11, a second adjustment resistor R12, and a third adjustment resistor R13, a fourth adjustment resistor R14, and a fifth adjustment resistor R15. The first adjustment resistor R11, the second adjustment resistor R12, the third adjustment resistor R13, the fourth adjustment resistor R14, and the fifth adjustment resistor R15 are sequentially arranged, and the first adjustment resistor R11 is closest to the first power supply end Vd1, and the fifth adjustment resistor R15 is farthest from the first power supply end Vd1.

For example, the adjustment sub-circuit 112 is provided with a plurality of voltage dividing output ends between the first power supply end Vd1 and the plurality of adjustment resistors to respectively output the plurality of voltage compensation amounts. As shown in FIG. 8, starting from an end close to the first power supply end Vd1, the adjustment sub-circuit 112 is provided with a first voltage dividing output end 1121, a second voltage dividing output end 1122, a third voltage dividing output end 1123, a fourth voltage dividing output end 1124, and a fifth voltage dividing output end 1125. The first voltage dividing output end 1121 outputs a first voltage compensation amount $\Delta VG_1$, the second voltage dividing output end 1122 outputs a second voltage compensation amount $\Delta VG_2$, the third voltage dividing output end 1123 outputs a third voltage compensation amount $\Delta VG_3$, the fourth voltage dividing output end 1124 outputs a fourth voltage compensation amount $\Delta VG_4$, and the fifth voltage dividing output end 1125 outputs a fifth voltage compensation amount $\Delta VG_5$. In addition to the first voltage dividing output end 1121, each of the remaining voltage dividing output ends is disposed between adjacent two adjustment resistors. For example, in the example shown in FIG. 8, the second voltage dividing output end 1122 is disposed between the first adjustment resistor R11 and the second adjustment resistor R12, the third voltage dividing output end 1123 is disposed between the second adjustment resistor R12 and the third adjustment resistor R13, the fourth voltage dividing output end 1124 is disposed between the third adjustment resistor R13 and the fourth adjustment resistor R14, and the fifth voltage dividing output end 1125 is disposed between the fourth adjustment resistor R14 and the fifth adjustment resistor R15.

For example, each voltage compensation amount may also be a sawtooth wave signal or the like, or each voltage compensation amount may also include a plurality of square waves having different amplitudes. The period of each voltage compensation amount is the same as the period of the standard signal.

For example, as shown in FIG. 6, a voltage dividing output end close to the first power supply end Vd1 is the first voltage dividing output end, a voltage dividing output end close to the signal generator 111 is an N-th voltage dividing output end, N represents the count of the plurality of adjustment resistors, and N≥2, an n-th voltage compensation amount output by an n-th voltage dividing output end of the plurality of voltage dividing output ends is expressed as:

$$\Delta VG_n = \frac{\Delta V_{max} \cdot \sum_{i=1}^{n-1} r_i}{\sum_{j=1}^{N} r_j}$$

Where n, i, and j are positive integers, n≤N, $\Delta VG_n$ represents the n-th voltage compensation amount, $\Delta V_{max}$ represents the standard signal, $r_i$ represents a resistance value of an i-th adjustment resistor, and $r_j$ represents a resistance value of a j-th adjustment resistor. For example, in the example shown in FIG. 8, the third voltage compensation amount ΔVG3 output by the third voltage dividing output end 1123 can be expressed as:

$$\Delta VG_3 = \frac{\Delta V_{max} \cdot (r_{11} + r_{12})}{r_{11} + r_{12} + r_{13} + r_{14} + r_{15}}$$

Where $r_{11}$ represents a resistance value of the first adjustment resistor R11, $r_{12}$ represents a resistance value of the second adjustment resistor R12, $r_{13}$ represents a resistance value of the third adjustment resistor R13, $r_{14}$ represents a resistance value of the fourth adjustment resistor R14, and $r_{15}$ represents a resistance value of the fifth adjustment resistor R15.

For example, the plurality of voltage compensation amounts output by the plurality of voltage dividing output ends of the adjustment sub-circuit 112 can be adjusted by adjusting the resistance values of the respective adjustment resistors.

It should be noted that, when designing the gamma voltage compensation circuit, first, the plurality of reference gamma voltages which are in one-to-one correspondence to the plurality of standard gray scale levels are obtained according to the selected plurality of standard gray scale levels, and then, maximum values of absolute values of the plurality of voltage compensation amounts corresponding to the plurality of reference gamma voltages (in this case, $V_{data}$ in the formula (1) represents a reference gamma voltage) are calculated according to the above formula (1), and finally the resistance values of the plurality of adjustment resistors are designed according to the maximum values of absolute values of voltage compensation amounts.

For example, in the embodiments of the present disclosure, the reference voltage $V_{ref}$ may be equal to an initial gamma voltage corresponding to the minimum gray scale of the display panel (i.e., 0 gray scale).

For example, the first power supply end Vd1 can be grounded.

For example, as shown in FIG. 6, the calculation circuit 120 includes a plurality of addition sub-circuits 121. The plurality of addition sub-circuits 121 are electrically connected to the plurality of voltage dividing output ends in one-to-one correspondence. Each of the addition sub-circuits 121 corresponds to one standard gray scale level, and is configured to receive a reference gamma voltage corresponding to the standard gray scale level and a voltage compensation amount corresponding to the standard gray scale level, and to add the reference gamma voltage and the voltage compensation amount to obtain a standard voltage signal corresponding to the standard gray scale level.

Figure 9:
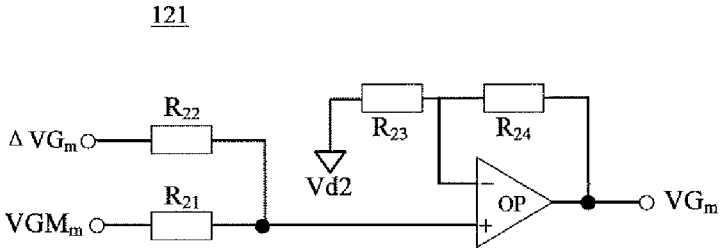
FIG. 9 is a schematic structural diagram of an addition sub-circuit according to some embodiments of the present disclosure.

For example, the addition sub-circuit 121 can be implemented using a hardware circuit. The addition sub-circuit 121 can be constituted, for example, by components such as a resistor, a capacitor, and an amplifier. FIG. 9 is a schematic structural diagram of an addition sub-circuit according to some embodiments of the present disclosure. For example, as shown in FIG. 9, each addition sub-circuit 121 includes an operational amplifier OP, a first resistor R21, a second resistor R22, a third resistor R23, and a fourth resistor R24. For example, a first end of the first resistor R21 is electrically connected to a non-inverting input end of the operational amplifier OP, and a second end of the first resistor R21 is configured to be electrically connected to a corresponding voltage dividing output end to receive the corresponding voltage compensation amount output by the corresponding voltage dividing output end; a first end of the second resistor R22 is electrically connected to the non-inverting input end of the operational amplifier OP, a second end of the second resistor R22 is configured to receive a corresponding reference gamma voltage; a first end of the third resistor R23 is electrically connected to an inverting input end of the operational amplifier OP, a second end of the third resistor R23 is electrically connected to a second power supply end Vd2; a first end of the fourth resistor R24 is electrically connected to the inverting input end of the operational amplifier OP, a second end of the fourth resistor R24 is electrically connected to an output end of the operational amplifier OP; the output end of the operational amplifier OP is configured to output a standard voltage signal corresponding to the standard gray scale level to the gamma circuit 130.

For example, as shown in FIG. 9, the standard voltage signal $VG_m$ can be expressed as:

$$VG_m = \left[\left(\frac{r_{21}}{r_{21}+r_{22}}\right)\cdot VGM_m + \left(\frac{r_{22}}{r_{21}+r_{22}}\right)\cdot \Delta VG_m\right]\cdot\left(1+\frac{r_{24}}{r_{23}}\right) \quad (2)$$

Where $VGM_m$ represents a reference gamma voltage corresponding to the addition sub-circuit 121, $\Delta VG_m$ represents a voltage compensation amount output by the voltage dividing output end corresponding to the addition sub-circuit 121, $r_{21}$, $r_{22}$, $r_{23}$, and $r_{24}$ represents a resistance value of the first resistor R21, a resistance value of the second resistor R22, a resistance value of the third resistor R23, and a resistance value of the fourth resistor R24, respectively.

For example, the resistance value of the first resistor R21 is the same as the resistance value of the second resistor R22, the resistance value of the third resistor R23 is the same as the resistance value of the fourth resistor R24, that is, $r_{21}=r_{22}$, $=r_{23}=r_{24}$, for example, the resistance value of the first resistor R21 and the resistance value of the third resistor R23 are also the same, that is, $r_{21}=r_{22}=r_{23}=r_{24}$, then the above formula (2) can be expressed as:

$$VG_m = VGM_m + \Delta VG_m$$

For example, the second power supply end Vd2 can be grounded.

For another example, the addition sub-circuit 121 can also be implemented by a signal processor such as an FPGA, a DSP, a CMU, or the like. The addition sub-circuit 121 may include, for example, a processor and a memory, and the processor executes a software program stored in the memory to implement a function of performing an adding operation on the reference gamma voltage and the voltage compensation amount.

For example, as shown in FIG. 6, the generation circuit 110 further includes a voltage follower 113. An input end of the voltage follower 113 is electrically connected to the output end of the signal generator 111, and an output end of the voltage follower 113 is electrically connected to the adjustment sub-circuit 112. The voltage follower 113 can isolate the signal generator 111 and the adjustment sub-circuit 112, thereby preventing mutual interference between the signal generator 111 and the adjustment sub-circuit 112. For example, as shown in FIG. 6, the voltage follower 113 may include an operational amplifier, a non-inverting input end of the operational amplifier is electrically connected to the output end of the signal generator 111, and an inverting input end of the operational amplifier is electrically connected to an output end of the operational amplifier, the output end of the operational amplifier is electrically connected to the adjustment sub-circuit 112.

It is worth noting that the circuit structure shown in FIG. 6 is only an exemplary implementation of the generation circuit and the calculation circuit. The specific structures of the generation circuit and the calculation circuit are not limited thereto, and the generation circuit and the calculation circuit may be constructed by other circuit structures, and the present disclosure is not limited thereto.

For example, as shown in FIG. 6, the gamma circuit 130 includes a plurality of gamma resistors connected in series (R31, R3*j*, R3*i*, and the like shown in FIG. 6). The gamma circuit is configured to divide the voltages of the plurality of standard voltage signals by the plurality of gamma resistors respectively to generate the plurality of compensation voltage signals which are in one-to-one correspondence to the plurality of gray scale levels of the display panel. For example, for 8-bit data, i.e., the number of the plurality of gray scale levels of the display panel is 256, the gamma voltage 130 may generate 256 compensation voltage signals based on the plurality of standard voltage signals (for example, five standard voltage signals) output by the calculation circuit 120, the 256 compensation voltage signals are in one-to-one correspondence to 256 gray scale levels (0-255 gray scale). The 256 compensation voltage signals include the plurality of standard voltage signals output by the calculation circuit 120.

For example, each compensation voltage signal may also be a sawtooth wave signal or the like, or each compensation voltage signal may also include a plurality of square waves having different amplitudes.

For example, as shown in FIG. 6, the gamma voltage compensation circuit 100 further includes an output circuit 140. The output circuit 140 is configured to output the compensated data voltage obtained based on the compensation voltage signal to the pixel drive circuit. The output circuit 140 may include a multiplexer MUX, an operational amplifier, and the like. An inverting input end and an output end of the operational amplifier are electrically connected, that is, the operational amplifier can be used as a voltage follower to prevent mutual interference between the multiplexer MUX and the pixel drive circuit.

For example, the output circuit 140 is electrically connected to the gamma circuit 130. In a case where a P-th row of pixels is scanned, for a T-th pixel located in the P-th row of pixels, the T-th pixel is set to display brightness corresponding to an S-th gray scale level, and the output circuit 140 is configured to: acquire a compensation voltage signal corresponding to the S-th gray scale level from the gamma circuit 130, determine a compensation voltage value corresponding to the P-th row of pixels in the compensation voltage signal; and output the compensation voltage value as a data voltage of the T-th pixel, where P, T, and S are all positive integers, P is greater than or equal to One and is less than or equal to the total count of rows of the display panel, T is greater than or equal to One and is less than or equal to the total count of columns of the display panel, and S is greater than or equal to 0 and is less than or equal to the total count of gray scale levels of the display panel (e.g., the total count of gray scale levels can be 256).

It should be noted that the compensation voltage value corresponding to the P-th row of pixels in the compensation voltage signal may be determined according to the timing, that is, in a case where the P-th row of pixels is scanned, the compensation voltage value corresponding to the P-th row of pixels may be the value of the compensation voltage signal corresponding to the P-th row of pixels at the falling edge of the scan signal GP of the P-th row of pixels.

Figure 10A:
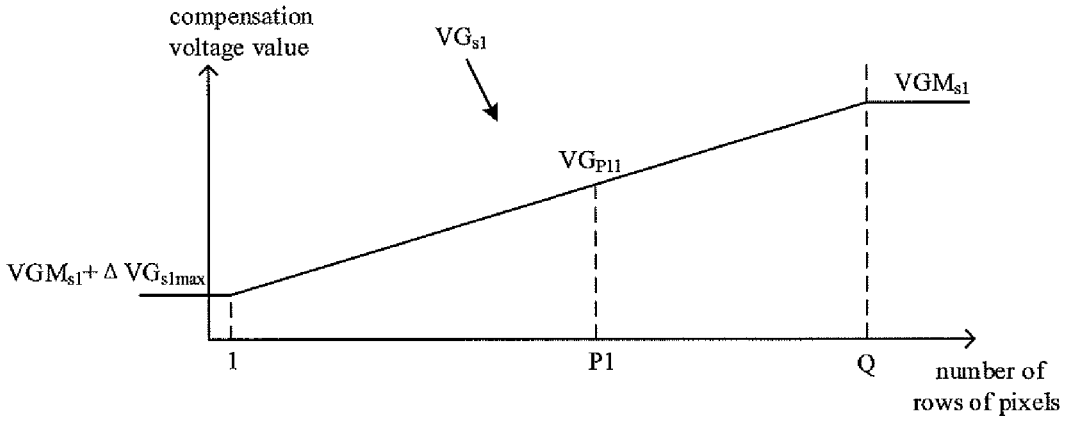
FIG. 10A is a schematic diagram of a compensation voltage signal corresponding to an S1-th gray scale level according to some embodiments of the present disclosure.
Figure 10B:
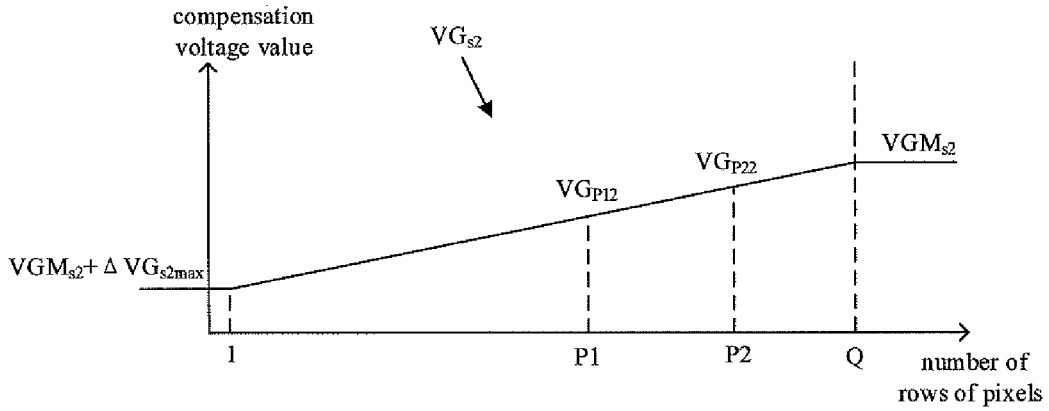
FIG. 10B is a schematic diagram of a compensation voltage signal corresponding to an S2-th gray scale level according to some embodiments of the present disclosure.

FIG. 10A is a schematic diagram of a compensation voltage signal corresponding to an S1-th gray scale level according to some embodiments of the present disclosure; FIG. 10B is a schematic diagram of a compensation voltage signal corresponding to an S2-th gray scale level according to some embodiments of the present disclosure.

For example, the plurality of initial gamma voltages are positive voltages, and the total number of rows of pixels of the display panel is Q. For example, in the examples shown in FIGS. 10A and 10B, the S1-th gray scale level is greater than the S2-th gray scale level. As shown in FIG. 10A and FIG. 10B, an initial gamma voltage corresponding to the S1-th gray scale level is represented as a first initial gamma voltage $VGM_{s1}$, and an initial gamma voltage corresponding to the S2-th gray scale level is represented as a second initial gamma voltage $VGM_{s2}$; under the first initial gamma voltage $VGM_{s1}$, $\Delta VG_{s1max}$ represents a difference between the gate voltage of the drive transistor of the T-th pixel of the first row of pixels of the display panel and the gate voltage of the drive transistor of the T-th pixel of the last row of pixels of the display panel; under the second initial gamma voltage $VGM_{s2}$, $\Delta VG_{s2max}$ represents a difference between the gate voltage of the drive transistor of the T-th pixel of the first row of pixels of the display panel and the gate voltage of the drive transistor of the T-th pixel of the last row of pixels of the display panel, and the absolute value of $\Delta VG_{s2max}$ is less than the absolute value of $\Delta VG_{s1max}$. A first compensation voltage signal $VG_{s1}$ represents the compensation voltage signal corresponding to the S1-th gray scale level, and a second compensation voltage signal $VG_{s2}$ represents the compensation voltage signal corresponding to the S2-th gray scale level. For example, in the examples shown in FIGS. 10A and 10B, both $\Delta VG_{s2max}$ and $\Delta VG_{s1max}$ are less than zero.

It should be noted that, in the embodiments of the present disclosure, the T-th pixel of the first row of pixels, the T-th pixel of the last row of pixels, and the T-th pixel of the P-th row of pixels are located in the same column, for example, located in a T-th pixel column.

For example, as shown in FIG. 10A, in a case where all the pixels in the T-th pixel column are configured to display brightness corresponding to the S1-th gray scale level, in the T-th pixel column, a compensation voltage value of a pixel located in the first row may be $VGM_{s1}+\Delta VG_{s1max}$, a compensation voltage value of a pixel located in the P1-th row may be $VG_{P11}$, and a compensation voltage value of a pixel located in the last row (i.e., a Q-th row) may be $VGM_{s1}$, that is, the compensation voltage value (that is, the data voltage) of the pixel located in the last row (i.e., the Q-th row) is the first initial gamma voltage $VGM_{s1}$ corresponding to the S1-th gray scale level. Therefore, the data voltage of the pixel located in the last row (i.e., the Q-th row) may not be compensated, but the present disclosure is not limited thereto, and in some embodiments, the data voltage of the pixel located in the last row (i.e., the Q-th row) may be compensated.

For example, as shown in FIG. 10B, in a case where all the pixels in a (T+1)-th pixel column are configured to display brightness corresponding to the S2-th gray scale level, in the (T+1)-th pixel column, a compensation voltage value of a pixel located in the first row may be $VGM_{s2}+\Delta VG_{s2max}$, a compensation voltage value of a pixel located in the P1-th row may be $VG_{P12}$, and a compensation voltage value of a pixel located in the last row (i.e., the Q-th row) may be $VGM_{s2}$, that is, the compensation voltage value (that is, the data voltage) of the pixel located in the last row (i.e., the Q-th row) is the second initial gamma voltage $VGM_{s2}$ corresponding to the S2-th gray scale level.

For example, as shown in FIGS. 10A and 10B, in the case where the pixel located in the P1-th row in the T-th pixel column is configured to display brightness corresponding to the S1-th gray scale level, and the pixel located in the P2-th row in the T-th pixel column is configured to display brightness corresponding to the S2-th gray scale level, in the T-th pixel column, in a case where the pixel located in the P1-th row is scanned, the compensation voltage value is obtained from the first compensation voltage signal $VG_{s1}$ corresponding to the S1-th gray scale level, that is, the compensation voltage value of the pixel located in the P1-th row may be $VG_{P11}$; in a case where the pixel located in the P2-th row is scanned, the compensation voltage value is obtained from the second compensation voltage signal $VG_{s2}$ corresponding to the S2-th gray scale level, that is, the compensation voltage value of the pixel located in the P2-th row may be $VG_{P22}$.

It should be noted that the "compensation voltage value of the pixel located in the P1-th row" may represent the compensated data voltage output by the output circuit 140 when the pixel of the P1-th row is scanned.

For example, the compensated data voltage corresponding to the T-th pixel located in the P-th row of pixels is expressed as:

$$V_{CP} = V_P - \frac{Q-P}{Q-1} \cdot \Delta V_{Pmax}$$

Where $V_{CP}$ represents a compensated data voltage corresponding to the T-th pixel of the P-th row of pixels, Q represents the total count of rows of pixels of the display panel, and Q is a positive integer, $V_P$ represents an initial gamma voltage corresponding to the S-th gray scale level, $\Delta V_{Pmax}$ represents a difference between a gate voltage of a drive transistor of the T-th pixel of the first row of pixels of the display panel and a gate voltage of a drive transistor of the T-th pixel of the last row of pixels of the display panel at the initial gamma voltage $V_P$, and $\Delta V_{Pmax}$ is expressed as: $\Delta V_{Pmax}=\alpha\cdot(V_{ref}-V_P)+\beta$, where $\alpha$ and $\beta$ represent compensation coefficients and are constant, and $V_{ref}$ represents a reference voltage. For example, the $V_{CP}$ may be the same as the compensation voltage value corresponding to the P-th row of pixels determined by the output circuit 140 described above.

It should be noted that, if the voltage compensation amount is negative, $\Delta V_{Pmax}$, $\Delta VG_{s1max}$, and $\Delta VG_{s2max}$ represent the minimum values of the voltage compensation amounts, that is, the negative high voltages; if the voltage compensation amount is positive, $\Delta V_{Pmax}$, $\Delta VG_{S1max}$, and $\Delta VG_{s2max}$ represent the maximum values of the voltage compensation amounts, that is, the positive high voltages.

Figure 11:
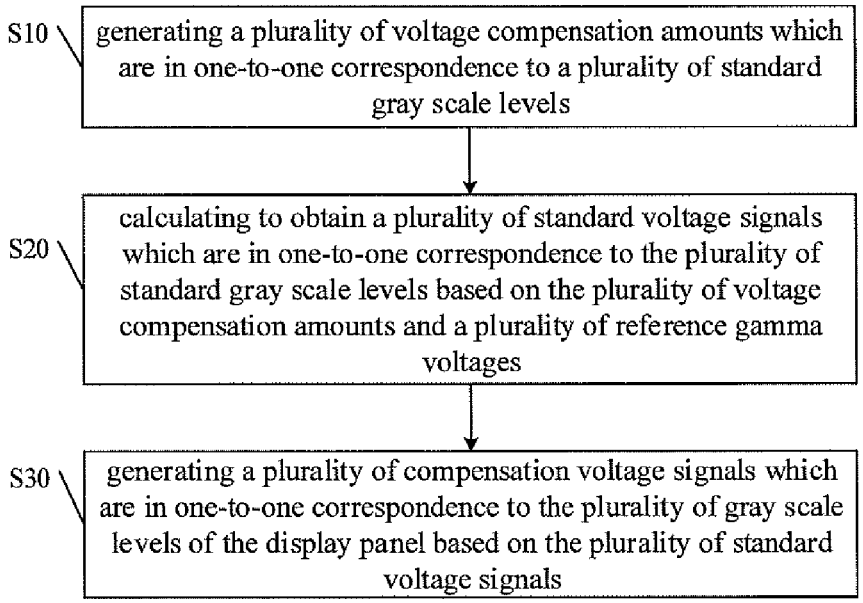
FIG. 11 is a flowchart of a gamma voltage compensation method according to some embodiments of the present disclosure.

At least some embodiments of the present disclosure also provide a gamma voltage compensation method, and the gamma voltage compensation method can be applied to the gamma voltage compensation circuit provided by any one of the above embodiments. FIG. 11 is a flowchart of a gamma voltage compensation method according to some embodiments of the present disclosure.

For example, as shown in FIG. 11, the gamma voltage compensation method includes:

S10: generating a plurality of voltage compensation amounts which are in one-to-one correspondence to a plurality of standard gray scale levels;

S20: calculating to obtain a plurality of standard voltage signals which are in one-to-one correspondence to the plurality of standard gray scale levels based on the plurality of voltage compensation amounts and a plurality of reference gamma voltages;

S30: generating a plurality of compensation voltage signals which are in one-to-one correspondence to the plurality of gray scale levels of the display panel based on the plurality of standard voltage signals.

For example, step S10 may include: generating a standard signal; determining the plurality of standard gray scale levels; and dividing a voltage of the standard signal to obtain the plurality of voltage compensation amounts based on the plurality of standard gray scale levels.

For example, in step S10, the standard signal is a sawtooth wave signal, and a period of the sawtooth wave signal is the same as a scan period of the display panel. It should be noted that the standard signal may also include a plurality of square waves. During the scan period of the display panel, the plurality of square waves have different amplitudes, the number of the plurality of square waves is the same as the total number of rows of the pixels on the display panel, each square wave corresponds to one row of pixels, and the width of each square wave is the same as the scan time of one row of pixels.

For example, in step S10, each voltage compensation amount may also be a sawtooth wave signal or the like, or each voltage compensation amount may also include a plurality of square waves having different amplitudes. The period of each voltage compensation amount is the same as the period of the standard signal.

For example, in step S30, each compensation voltage signal may also be a sawtooth wave signal or the like, or each compensation voltage signal may also include a plurality of square waves having different amplitudes.

For example, in a case where the P-th row of pixels is scanned, for the T-th pixel located in the P-th row of pixels, the T-th pixel is set to display brightness corresponding to the S-th gray scale level, in this case, the gamma voltage compensation method further includes: S40, acquiring a compensation voltage signal corresponding to the S-th gray scale level from the plurality of compensation voltage signals, determining a compensation voltage value corresponding to the P-th row of pixels in the compensation voltage signal; outputting the compensation voltage value as a data voltage of the T-th pixel, where P, T, and S are all positive integers, P is greater than or equal to One and is less than or equal to the total count of rows of the display panel, T is greater than or equal to One and is less than or equal to the total count of columns of the display panel, and S is greater than or equal to 0 and is less than or equal to the total count of gray scale levels of the display panel.

For example, the generation circuit in the gamma voltage compensation circuit can perform the operation of step S10, the calculation circuit in the gamma voltage compensation circuit can perform the operation of step S20, and the gamma circuit in the gamma voltage compensation circuit can perform the operation of step S30, the output circuit in the gamma voltage compensation circuit can perform the operation of step S40.

For specific operations of the steps S10, S20, S30, and S40, reference may be made to the related description in the embodiments of the gamma voltage compensation circuit, and details are not described herein again.

Figure 12:
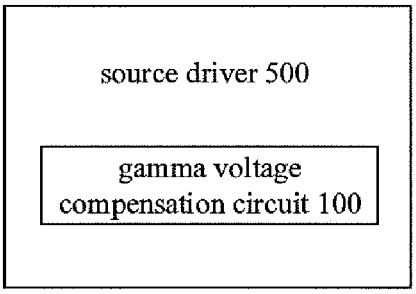
FIG. 12 is a schematic diagram of a source driver according to some embodiments of the present disclosure.

At least some embodiments of the present disclosure also provide a source driver. FIG. 12 is a schematic diagram of a source driver according to some embodiments of the present disclosure. For example, as shown in FIG. 12, the source driver 500 includes the gamma voltage compensation circuit 100 according to any one of the above embodiments. The gamma voltage compensation circuit 100 is configured to output a compensation voltage value corresponding to each pixel (i.e., a compensated data voltage corresponding to each pixel). The source driver 500 is electrically connected to a pixel drive circuit via a data line for supplying the compensated data voltage output by the gamma voltage compensation circuit 100 to the pixel drive circuit.

The source driver according to the embodiment of the present disclosure compensates the gamma voltage by the gamma voltage compensation circuit, thereby compensating the data voltage output by the source driver, improving display uniformity of the display panel. In addition, compared with the compensation method of adding the compensation circuit to each output channel of the source driver, only one gamma voltage compensation circuit needs to be added in the present disclosure to compensate all the data voltages output by the source driver, so that a structure of the source driver is simple, and the occupied area of the source driver is reduced.

For example, the source driver 500 may further include a digital to analog conversion circuit and an output buffer amplifier, and the digital to analog conversion circuit is configured to convert the digital data signal into a corresponding analog data signal. The output buffer amplifier is used to further amplify the analog data signal to drive a large capacitive load connected to the data line, for example, the large capacitive load has a capacitance level of $10^2$ pF. The output buffer amplifier can include a two-stage operational amplifier structure, the first stage operational amplifier structure can be a differential amplifier, and the second stage operational amplifier structure can be an output operational amplifier.

Figure 13:
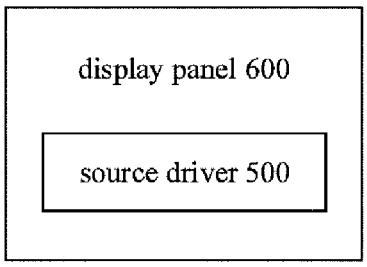
FIG. 13 is a schematic diagram of a display panel according to some embodiments of the present disclosure.

At least some embodiments of the present disclosure also provide a display panel. FIG. 13 is a schematic diagram of a display panel according to some embodiments of the present disclosure. For example, as shown in FIG. 13, the display panel 600 includes the source driver 500 according to any one of the above embodiments.

For example, the display panel 600 may be an organic light-emitting diode (OLED) display panel, a quantum dot light-emitting diode (QLED) display panel, or the like.

For example, the source driver 500 can be implemented by an application specific integrated circuit chip or can be directly fabricated on the display panel 600 by a semiconductor fabrication process.

For example, display panel 600 also includes a plurality of pixels arranged in an array. Each pixel includes a pixel drive circuit and a light-emitting element, and the pixel drive circuit may be the pixel drive circuit shown in FIG. 2A or 2B, and the light-emitting element may be an organic light-emitting diode, a quantum dot light-emitting diode, or the like. The scan timing diagram of the display panel 600 may include the timing diagram shown in FIG. 7C, that is, has an independent light-emitting phase.

For example, the gamma voltage compensation circuit in the source driver is electrically connected to a data line via an output buffer, and the output buffer is used to amplify the signal output by the gamma voltage compensation circuit to drive a large capacitive load connected to the data line, for example, the large capacitive load has a capacitance level of $10^2$ pF. The data line is electrically connected to a pixel drive circuit in the pixel. The gamma voltage compensation circuit is configured to determine a plurality of compensation voltage values (i.e., a plurality of compensated data voltages) based on a plurality of compensation voltage signals, and output the compensation voltage value corresponding to the pixel in the plurality of compensation voltage values to the pixel drive circuit of the pixel, so that the pixel drive circuit can drive the light-emitting element in the pixel to emit light based on the corresponding compensation voltage value.

For example, the display panel 600 may be a rectangular panel, a circular panel, an elliptical panel, or a polygonal panel. In addition, the display panel 600 can be not only a flat panel but also a curved panel or even a spherical panel.

For example, the display panel 600 can be applied to any product or component having a display function such as a mobile phone, a tablet computer, a television, a display, a notebook computer, a digital photo frame, a navigator, and the like.

For the present disclosure, the following statements should be noted:

(1) The accompanying drawings of the embodiments of the present disclosure relate only to the structures in connection with the embodiments of the present disclosure, and other structures can be referred to the general design.

(2) In the case of no conflict, the embodiments of the present disclosure and the features in the embodiments can be combined with each other to obtain new embodiment(s).

What have been described above are only specific implementations of the present disclosure, but the protection scope of the present disclosure is not limited thereto, and the protection scope of the present disclosure should be determined by the protection scope of the claims.

What is claimed is:

1. A gamma voltage compensation circuit, comprising:

a generation circuit, configured to generate a plurality of voltage compensation amounts, wherein the plurality of voltage compensation amounts are in one-to-one correspondence to a plurality of standard gray scale levels;

a calculation circuit, connected to the generation circuit, and configured to acquire the plurality of voltage compensation amounts and select gamma voltages corresponding to the plurality of standard gray scale levels from a plurality of initial gamma voltages, corresponding to a plurality of gray scale levels of a display panel and obtained according to a gamma curve and a transmittance-voltage curve, as a plurality of reference gamma voltages, and to obtain a plurality of standard voltage signals based on the plurality of reference gamma voltages and the plurality of voltage compensation amounts, wherein the plurality of reference gamma voltages are also in one-to-one correspondence to the plurality of standard gray scale levels; and a gamma circuit, electrically connected to the calculation circuit, and configured to generate a plurality of compensation voltage signals based on the plurality of standard voltage signals, wherein the plurality of compensation voltage signals are in one-to-one correspondence to the plurality of gray scale levels of the display panel.

2. The gamma voltage compensation circuit according to claim 1, wherein the gamma circuit comprises a plurality of gamma resistors connected in series, the gamma circuit is configured to divide voltages of the plurality of standard voltage signals by the plurality of gamma resistors respectively to generate the plurality of compensation voltage signals which are in one-to-one correspondence to the plurality of gray scale levels of the display panel.

3. The gamma voltage compensation circuit according to claim 1, further comprising an output circuit, wherein the output circuit is electrically connected to the gamma circuit, in a case where a P-th row of pixels is scanned, for a T-th pixel located in the P-th row of pixels, the T-th pixel is set to display brightness corresponding to an S-th gray scale level, and the output circuit is configured to:

acquire a compensation voltage signal corresponding to the S-th gray scale level from the gamma circuit;

determine a compensation voltage value corresponding to the P-th row of pixels in the compensation voltage signal; and output the compensation voltage value as a data voltage of the T-th pixel, wherein, P, T, and S are all positive integers, P is greater than or equal to One and is less than or equal to a total count of rows of the display panel, T is greater than or equal to One and is less than or equal to a total count of columns of the display panel, and S is greater than or equal to 0 and is less than or equal to a total count of gray scale levels of the display panel.

4. The gamma voltage compensation circuit according to claim 3, wherein the data voltage corresponding to the T-th pixel located in the P-th row of pixels is expressed as:

$$V_{CP} = V_P - \frac{Q-P}{Q-1} \cdot \Delta V_{Pmax}$$

wherein $V_{CP}$ represents the data voltage corresponding to the T-th pixel of the P-th row of pixels, Q represents the total count of rows of pixels of the display panel, Q is a positive integer, $V_P$ represents an initial gamma voltage corresponding to the S-th gray scale level, $\Delta V_{Pmax}$ represents a difference between a gate voltage of a drive transistor of a T-th pixel of a first row of pixels of the display panel and a gate voltage of a drive transistor of a T-th pixel of a last row of pixels of the display panel at the initial gamma voltage $V_P$, and $\Delta V_{Pmax}$ is expressed as:

$$\Delta V_{Pmax} = \alpha \cdot (V_{ref} - V_P) + \beta,$$

where $\alpha$ and $\beta$ represent compensation coefficients and are constant, and $V_{ref}$ represents a reference voltage.

5. The gamma voltage compensation circuit according to claim 1, wherein the generation circuit comprises a signal generator and an adjustment sub-circuit, the signal generator is configured to generate a standard signal; and the adjustment sub-circuit is electrically connected to an output end of the signal generator and is configured to divide a voltage of the standard signal to obtain the plurality of voltage compensation amounts.

6. The gamma voltage compensation circuit according to claim 5, wherein the standard signal is a sawtooth wave signal, and a period of the sawtooth wave signal is identical to a scan period of the display panel.

7. The gamma voltage compensation circuit according to claim 5, wherein the generation circuit further comprises a voltage follower, an input end of the voltage follower is electrically connected to the output end of the signal generator, and an output end of the voltage follower is electrically connected to the adjustment sub-circuit.

8. The gamma voltage compensation circuit according to claim 5, further comprising an output circuit, wherein the output circuit is electrically connected to the gamma circuit, in a case where a P-th row of pixels is scanned, for a T-th pixel located in the P-th row of pixels, the T-th pixel is set to display brightness corresponding to an S-th gray scale level, and the output circuit is configured to:

acquire a compensation voltage signal corresponding to the S-th gray scale level from the gamma circuit;

determine a compensation voltage value corresponding to the P-th row of pixels in the compensation voltage signal; and output the compensation voltage value as a data voltage of the T-th pixel, wherein, P, T, and S are all positive integers, P is greater than or equal to One and is less than or equal to a total count of rows of the display panel, T is greater than or equal to One and is less than or equal to a total count of columns of the display panel, and S is greater than or equal to 0 and is less than or equal to a total count of gray scale levels of the display panel.

9. The gamma voltage compensation circuit according to claim 5, wherein the adjustment sub-circuit comprises a plurality of adjustment resistors, the plurality of adjustment resistors are arranged in series between the output end of the signal generator and a first power supply end, and the adjustment sub-circuit is provided with a plurality of voltage dividing output ends between the first power supply end and the plurality of adjustment resistors to respectively output the plurality of voltage compensation amounts.

10. The gamma voltage compensation circuit according to claim 9, wherein a voltage dividing output end close to the first power supply end is a first voltage dividing output end, a voltage dividing output end close to the signal generator is an N-th voltage dividing output end, N represents a count of the plurality of adjustment resistors, and N≥2, an n-th voltage compensation amount of the plurality of voltage compensation amounts output by an n-th voltage dividing output end of the plurality of voltage dividing output ends is expressed as:

$$\Delta VG_n = \frac{\Delta V_{max} \cdot \sum_{i=1}^{n-1} r_i}{\sum_{j=1}^{N} r_j}$$

wherein n, i, and j are positive integers, n≤N, $\Delta VG_n$ represents the n-th voltage compensation amount, $\Delta V_{max}$ represents the standard signal, $r_i$ represents a resistance value of an i-th adjustment resistor of the plurality of adjustment resistors, and $r_j$ represents a resistance value of a j-th adjustment resistor of the plurality of adjustment resistors.

11. The gamma voltage compensation circuit according to claim 9, wherein the calculation circuit comprises a plurality of addition sub-circuits, the plurality of addition sub-circuits are electrically connected to the plurality of voltage dividing output ends in one-to-one correspondence, each of the plurality of addition sub-circuits corresponds to one standard gray scale level of the plurality of standard gray scale levels, and is configured to receive a reference gamma voltage corresponding to the standard gray scale level and a voltage compensation amount corresponding to the standard gray scale level and to add the reference gamma voltage and the voltage compensation amount to obtain a standard voltage signal corresponding to the standard gray scale level.

12. The gamma voltage compensation circuit according to claim 11, wherein each of the plurality of addition sub-circuits comprises an operational amplifier, a first resistor, a second resistor, a third resistor, and a fourth resistor, a first end of the first resistor is electrically connected to a non-inverting input end of the operational amplifier, and a second end of the first resistor is configured to be electrically connected to a corresponding voltage dividing output end to receive the voltage compensation amount;

a first end of the second resistor is electrically connected to the non-inverting input end of the operational amplifier, and a second end of the second resistor is configured to receive the reference gamma voltage;

a first end of the third resistor is electrically connected to an inverting input end of the operational amplifier, and a second end of the third resistor is electrically connected to a second power supply end;

a first end of the fourth resistor is electrically connected to the inverting input end of the operational amplifier, and a second end of the fourth resistor is electrically connected to an output end of the operational amplifier; and the output end of the operational amplifier outputs the standard voltage signal corresponding to the standard gray scale level to the gamma circuit.

13. The gamma voltage compensation circuit according to claim 12, wherein a resistance value of the first resistor is identical to a resistance value of the second resistor, and a resistance value of the third resistor is identical to a resistance value of the fourth resistor.

14. A gamma voltage compensation method for a gamma voltage compensation circuit, wherein the gamma voltage compensation circuit comprises: a generation circuit, configured to generate a plurality of voltage compensation amounts, wherein the plurality of voltage compensation amounts are in one-to-one correspondence to a plurality of standard gray scale levels; a calculation circuit, connected to the generation circuit, and configured to acquire the plurality of voltage compensation amounts and select gamma voltages corresponding to the plurality of standard gray scale levels from a plurality of initial gamma voltages, corresponding to a plurality of gray scale levels of a display panel and obtained according to a gamma curve and a transmittance-voltage curve, as a plurality of reference gamma voltages, obtain a plurality of standard voltage signals based on the plurality of reference gamma voltages and the plurality of voltage compensation amounts, wherein the plurality of reference gamma voltages are also in one-to-one correspondence to the plurality of standard gray scale levels; and a gamma circuit, electrically connected to the calculation circuit, and configured to generate a plurality of compensation voltage signals based on the plurality of standard voltage signals, wherein the plurality of compensation voltage signals are in one-to-one correspondence to the plurality of gray scale levels of the display panel, the gamma voltage compensation method comprises:

generating the plurality of voltage compensation amounts which are in one-to-one correspondence to the plurality of standard gray scale levels;

calculating to obtain the plurality of standard voltage signals based on the plurality of voltage compensation amounts and the plurality of reference gamma voltages, wherein the plurality of standard voltage signals are in one-to-one correspondence to the plurality of standard gray scale levels; and generating the plurality of compensation voltage signals based on the plurality of standard voltage signals, wherein the plurality of compensation voltage signals are in one-to-one correspondence to the plurality of gray scale levels of the display panel.

15. The gamma voltage compensation method according to claim 14, wherein each of the plurality of compensation voltage signals is a sawtooth wave signal.

16. The gamma voltage compensation method according to claim 14, wherein in a case where a P-th row of pixels is scanned, for a T-th pixel located in the P-th row of pixels, the T-th pixel is set to display brightness corresponding to an S-th gray scale level, the gamma voltage compensation method further comprises:

acquiring a compensation voltage signal corresponding to the S-th gray scale level from the plurality of compensation voltage signals;

determining a compensation voltage value corresponding to the P-th row of pixels in the compensation voltage signal; and outputting the compensation voltage value as a data voltage of the T-th pixel, wherein, P, T, and S are all positive integers, P is greater than or equal to One and is less than or equal to a total count of rows of the display panel, T is greater than or equal to One and is less than or equal to a total count of columns of the display panel, and S is greater than or equal to 0 and is less than or equal to a total count of gray scale levels of the display panel.

17. The gamma voltage compensation method according to claim 14, wherein generating the plurality of voltage compensation amounts which are in one-to-one correspondence to the plurality of standard gray scale levels comprises:

generating a standard signal;

determining the plurality of standard gray scale levels; and dividing a voltage of the standard signal to obtain the plurality of voltage compensation amounts based on the plurality of standard gray scale levels.

18. The gamma voltage compensation method according to claim 17, wherein the standard signal is a sawtooth wave signal, and a period of the sawtooth wave signal is identical to a scan period of the display panel.

19. A source driver, comprising a gamma voltage compensation circuit, wherein the gamma voltage compensation circuit comprises: a generation circuit, configured to generate a plurality of voltage compensation amounts, wherein the plurality of voltage compensation amounts are in one-to-one correspondence to a plurality of standard gray scale levels; a calculation circuit, connected to the generation circuit, and configured to acquire the plurality of voltage compensation amounts and select gamma voltages corresponding to the plurality of standard gray scale levels from a plurality of initial gamma voltages, corresponding to a plurality of gray scale levels of a display panel and obtained according to a gamma curve and a transmittance-voltage curve, as a plurality of reference gamma voltages, obtain a plurality of standard voltage signals based on the plurality of reference gamma voltages and the plurality of voltage compensation amounts, wherein the plurality of reference gamma voltages are also in one-to-one correspondence to the plurality of standard gray scale levels; and a gamma circuit, electrically connected to the calculation circuit, and configured to generate a plurality of compensation voltage signals based on the plurality of standard voltage signals, wherein the plurality of compensation voltage signals are in one-to-one correspondence to the plurality of gray scale levels of the display panel.

20. A display panel, comprising the source driver according to claim 19.

* * * * *